US011710592B2

(12) United States Patent
Mantoan

(10) Patent No.: US 11,710,592 B2
(45) Date of Patent: Jul. 25, 2023

(54) BI-STABLE MECHANICAL LATCH INCLUDING POSITIONING SPHERES

(71) Applicant: Littelfuse, Inc., Chicago, IL (US)

(72) Inventor: Davide Mantoan, Legnago (IT)

(73) Assignee: Littelfuse, Inc., Chicago, IL (US)

( * ) Notice: Subject to any disclaimer, the term of this patent is extended or adjusted under 35 U.S.C. 154(b) by 728 days.

(21) Appl. No.: 16/686,168

(22) Filed: Nov. 17, 2019

(65) Prior Publication Data

US 2021/0151233 A1 May 20, 2021

(51) Int. Cl.

| | |
|---|---|
| ***H01F 7/124*** | (2006.01) |
| ***H01F 7/08*** | (2006.01) |
| ***E05B 63/12*** | (2006.01) |
| ***H01F 7/16*** | (2006.01) |
| ***E05C 19/04*** | (2006.01) |

(52) U.S. Cl.

CPC ..... *H01F 7/124* (2013.01); *E05B 63/121* (2013.01); *H01F 7/088* (2013.01); *E05C 19/04* (2013.01); *H01F 2007/1669* (2013.01)

(58) Field of Classification Search

CPC .. E05B 63/121; E05B 17/2011; E05C 19/009; E05C 19/04; H01F 7/124; H01F 7/088; H01F 2007/1669; Y10T 292/14

USPC ..... 292/252

See application file for complete search history.

(56) References Cited

U.S. PATENT DOCUMENTS 1,510,445 A * 9/1924 Henry ..... E05B 63/121 74/2

3,585,810 A 6/1971 Sander (Continued)

FOREIGN PATENT DOCUMENTS

EP 0863531 A1 9/1998
EP 1469499 A1 10/2004

(Continued)

OTHER PUBLICATIONS

Espacenet machine translation of FR 2708687, Baraniak, Telescopic mechanical Coupling Device with Lockable Rectilinear Travel, dated Feb. 10, 1995 (Year: 2023).*

(Continued)

*Primary Examiner* — Kristina R Fulton
*Assistant Examiner* — Steven A Tullia
(74) *Attorney, Agent, or Firm* — KDW Firm PLLC

(57) ABSTRACT

Provided herein is an improved a bi-stable actuator including a first core component coupleable to a housing, the first core component including a central bore containing a shaft and a shaft spring. The actuator may further include a second core component extending around the first core component, wherein the second core component and the first core component are axially moveable relative to one another, and a third core component extending within the second core component, wherein the third core component and the second core component are axially moveable relative to one another. The actuator may further include a positioning sphere extending through an opening of the first core component, wherein the positioning sphere abuts the second core component when the bi-stable actuator is in a first position, and wherein the positioning sphere abuts a detent of the shaft when the bi-stable actuator is in a second position.

19 Claims, 6 Drawing Sheets

(56) References Cited

U.S. PATENT DOCUMENTS 3,696,744 A * 10/1972 Etchell ..... B41F 27/1231 101/415.1
3,943,852 A * 3/1976 Czinger ..... B41F 27/14 101/415.1
3,944,768 A 3/1976 Aryamane et al.
4,082,342 A * 4/1978 Ailshie ..... B62D 33/071 292/144
4,127,835 A 11/1978 Knutson
4,586,425 A * 5/1986 Redman ..... F15B 15/261 92/24
4,601,502 A * 7/1986 Van Dyke ..... E05C 17/48 292/332
4,647,089 A * 3/1987 Zangrando ..... E05B 51/02 292/144
4,845,392 A 7/1989 Mumbower
5,381,295 A * 1/1995 Rund ..... H02J 7/0031 361/72
5,771,742 A * 6/1998 Bokaie ..... E05B 47/0009 337/140
6,246,131 B1 6/2001 Sheng
8,083,274 B2 * 12/2011 Caldwell ..... B60R 21/34 70/276
9,103,144 B2 * 8/2015 Liang ..... E05C 17/62
9,206,908 B2 * 12/2015 Howard ..... A62C 37/04
2012/0318534 A1 * 12/2012 Dahlgren ..... F16K 35/16 169/11
2020/0291678 A1 * 9/2020 Eickhoff ..... E05B 47/0005

FOREIGN PATENT DOCUMENTS

EP 1757758 A2 * 2/2007 ..... E05B 17/0058
FR 2708687 A1 * 2/1995 ..... F15B 15/261
GB 2484110 A * 4/2012 ..... E05B 17/2011
JP 57186312 A 11/1982
JP 58148411 A 9/1983
JP 58155706 A 9/1983
WO 2013004405 A1 1/2013
WO WO-2014146801 A1 * 9/2014 ..... F01L 1/047
WO WO-2014146801 A1 * 9/2014 ..... F01L 1/047

OTHER PUBLICATIONS

International Search Report and Written Opinion dated Feb. 8, 2021 for PCT/US2020/059319 filed Nov. 6, 2020.

* cited by examiner

BI-STABLE MECHANICAL LATCH INCLUDING POSITIONING SPHERES

FIELD OF THE INVENTION

The disclosure relates generally to the field of mechanical latches and, more particularly, to a bi-stable mechanical latch including positioning spheres.

BACKGROUND OF THE DISCLOSURE

An electrical battery switch or battery disconnect is a device that enables or disenables an electrical connection to be made between two studs or poles in order to transmit current from a an electrical source to other electrical load. Some relays include a coil and a permanent magnet. When current flows through the coil, a magnetic field is created proportional to the current flow. At a predetermined point, the magnetic field is sufficiently strong to pull the switch's movable contact from its rest, or de-energized position, to its actuated, or energized position pressed against the switch's fixed contacts.

A solenoid is a specific type of high-current electromagnetic relay. Solenoid operated switches are widely used to supply power to a load device in response to a relatively low level control current supplied to the solenoid. Solenoids may be used in a variety of applications. For example, solenoids may be used in electric starters for ease and convenience of starting various vehicles, including conventional automobiles, trucks, lawn tractors, larger lawn mowers, and the like.

A normally open relay is a switch that keeps its contacts closed while being supplied with the electric power and that opens its contacts when the power supply is cut off. What is needed with normally open relays are solutions to reduce the number of components and to increase the life length of the switch.

SUMMARY OF THE DISCLOSURE

In one approach according to the present disclosure, a latching assembly, may include a housing including an opening and a bi-stable actuator, the bi-stable actuator including a first core component coupled to the housing, the first core component including a central bore including a shaft and a shaft spring. The bi-stable actuator may further include a second core component extending around the first core component, wherein the second core component and the first core component are axially moveable relative to one another, and a third core component extending within the second core component, wherein the third core component and the second core component are axially moveable relative to one another. The bi-stable actuator may further include a positioning sphere extending through an opening of the first core component, wherein the positioning sphere abuts the second core component when the bi-stable actuator is in a first position, and wherein the positioning sphere abuts a detent of the shaft when the bi-stable actuator is in a second position.

In another approach of the disclosure, a bi-stable mechanical latching actuator may include a first core component coupleable to a housing, the first core component including a central bore receiving a shaft and a shaft spring, and a second core component extending around the first core component, wherein the second core component and the first core component are axially moveable relative to one another. The bi-stable actuator may further include a third core component extending within the second core component, wherein the third core component and the second core component are axially moveable relative to one another, and a positioning sphere extending through an opening of the first core component, wherein the positioning sphere abuts the second core component when in a first position, and wherein the positioning sphere abuts a detent of the shaft when in a second position.

In yet another approach of the present disclosure, a method may include providing a bi-stable actuator, the bi-stable actuator including a first core component coupled to the housing, the first core component including a central bore including a shaft and a shaft spring. The bi-stable actuator may further include a second core component extending around the first core component, wherein the second core component and the first core component are axially moveable relative to one another, and a third core component extending within the second core component, wherein the third core component and the second core component are axially moveable relative to one another. The bi-stable actuator may further include a positioning sphere positioned within an opening of the first core component. The method may further include biasing the third core component within the second core component from a first radial position to a second radial position, wherein the positioning sphere abuts the second core component when the third core component is in the first radial position, and wherein the positioning sphere abuts a detent of the shaft when the third core component is in the second radial position.

BRIEF DESCRIPTION OF THE DRAWINGS

The accompanying drawings illustrate exemplary approaches of the disclosed embodiments so far devised for the practical application of the principles thereof, and in which.

Figure 1:
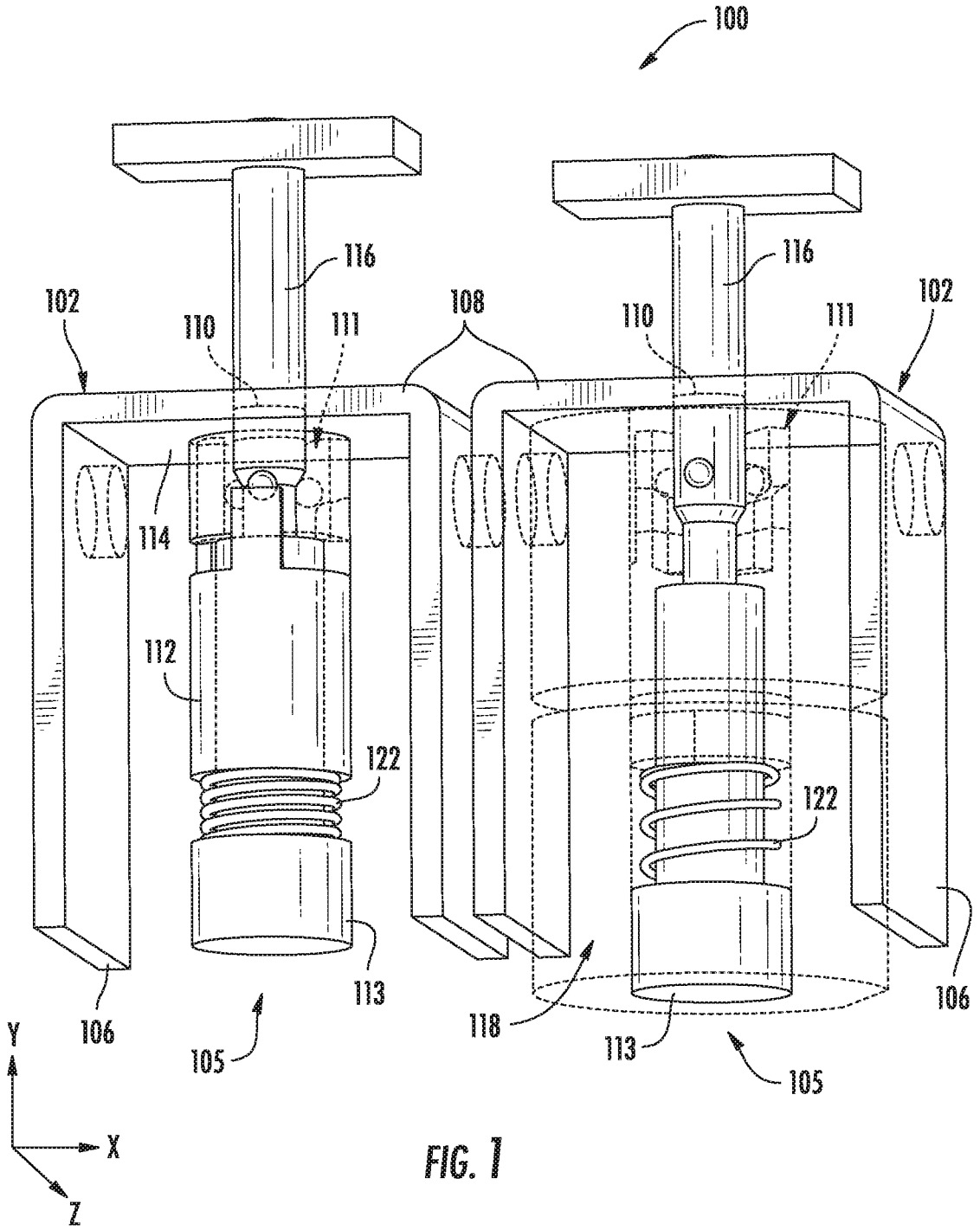
FIG. 1 depicts a perspective view of a latching assembly according to embodiments of the present disclosure.

The drawings are not necessarily to scale. The drawings are merely representations, not intended to portray specific parameters of the disclosure. The drawings are intended to depict typical embodiments of the disclosure, and therefore should not be considered as limiting in scope. In the drawings, like numbering represents like elements.

Furthermore, certain elements in some of the figures may be omitted, or illustrated not-to-scale, for illustrative clarity. Furthermore, for clarity, some reference numbers may be omitted in certain drawings.

DETAILED DESCRIPTION

Embodiments in accordance with the present disclosure will now be described more fully hereinafter with reference to the accompanying drawings. The assemblies, components thereof, and methods may be embodied in many different forms and should not be construed as being limited to the embodiments set forth herein. Rather, these embodiments are provided so that this disclosure will be thorough and complete, and will fully convey the scope of the assemblies, components, and methods to those skilled in the art.

As will be described herein, embodiments of the present disclosure relate to a novel bi-stable mechanism based on two different positions that a set of (i.e., one or more) spheres can assume in a complex assembly with fixed and mobile components. In some embodiments, ON and OFF may be guaranteed by the mutual position of a latching mobile core and a shaft. Both these components may have appropriate recesses or detents to host the spheres. When recesses in the shaft are present in front of the spheres, the spheres are directed into the recesses so that latching the mobile core is free/forced (e.g., by a spring) to move. In the same way, when recesses of the mobile core are present in front of the spheres, the spheres are directed into the mobile core recesses, so that the shaft is free/forced (e.g., by a second spring) to move. To switch between the two positions, an external force may be applied, wherein the force can be mechanical, magnetic, electromechanical, or any other.

It will be appreciated that the bi-stable mechanism of the present disclosure can be applied to, for example, a battery disconnecting switch, relay, or similar device(s) having the feature of bistability. The bi-stable mechanism is operable with external forces generated by electromagnetism.

FIG. 1 illustrates a latch assembly (hereinafter "assembly") 100 according to embodiments of the present disclosure. The assembly 100 may include one or more housings 102 each coupled to a bi-stable actuator (hereinafter "actuator") 105. Although not limited to any particular configuration, the housing 102 may include a set of sidewalls 106 connected to a top wall 108, wherein an opening 110 may be provided through the top wall 108. As will be described in greater detail herein, the actuator 105 may include a first core component 111 coupled to the housing 102, for example, along an underside 114 thereof. The actuator 105 may further include a second core component 112 extending around the first core component 111, wherein the first and second core components 111, 112 are axially movable with respect to one another (e.g., along the y-axis), and a third core component 113 extending within the second core component 112, wherein the second and third core components 112, 113 are axially movable with respect to one another. A shaft 116 of the actuator 105 is configured to extend through the opening 110 through the top wall 108 of the housing 102.

In one non-limiting embodiment, the actuator 105 may be part of a bi-stable relay, also referred to as a "latching relay." As known, a bi-stable relay is a relay that remains in its last state when power to the relay is shut off. In general, the bi-stable relay includes a switching mechanism, such as the actuator 105, to open or close electrical contact between terminals. In some examples, the bi-stable relay may be formed from a solenoid operating various components to open or close the switching mechanism contacts.

As yet another example, the bi-stable relay may be formed from a pair of permanent magnets 118 surrounding a ferrous plunger, such as shaft 116 and/or the first, second, third core components 111, 112, 113. The ferrous plunger may be disposed within the center of a coil of the permanent magnets 118, wherein a core spring 122 is provided to push the ferrous plunger out of the coil. During operation, when the coil is energized in one direction, the magnetic field pushes the ferrous plunger away from the permanent magnets 118 and the core spring 122 keeps it in the "released" position, which may correspond to either the open or closed position depending on the positioning and connection of the contacts. When the coil is energized in the other direction, the magnetic field pulls the plunger back into range of the permanent magnets 118, and it is held (e.g., against the spring force of the core spring 122) in place by the permanent magnets 118.

In further examples, the coil may include a center-tapped winding, which can be connected to the positive side of a voltage source. As such, each end of the coil corresponds to the open or close winding. In alternative examples, the coil may include two separate windings, namely one for the open and one for the close.

During use, the assembly 100 may be configured to cause the actuator 105 to enter either an open or closed state when a particular condition occurs (e.g., input power on a power rail is interrupted). As used herein, input power may be interrupted when: the input power falls below a specified value; when the input power falls to zero; when the input power is reduced by a specified percentage; when the input power falls below a specified value for a specified amount of time; or generally whenever there is a reduction or interrupt in the supply of power available.

Figure 2:
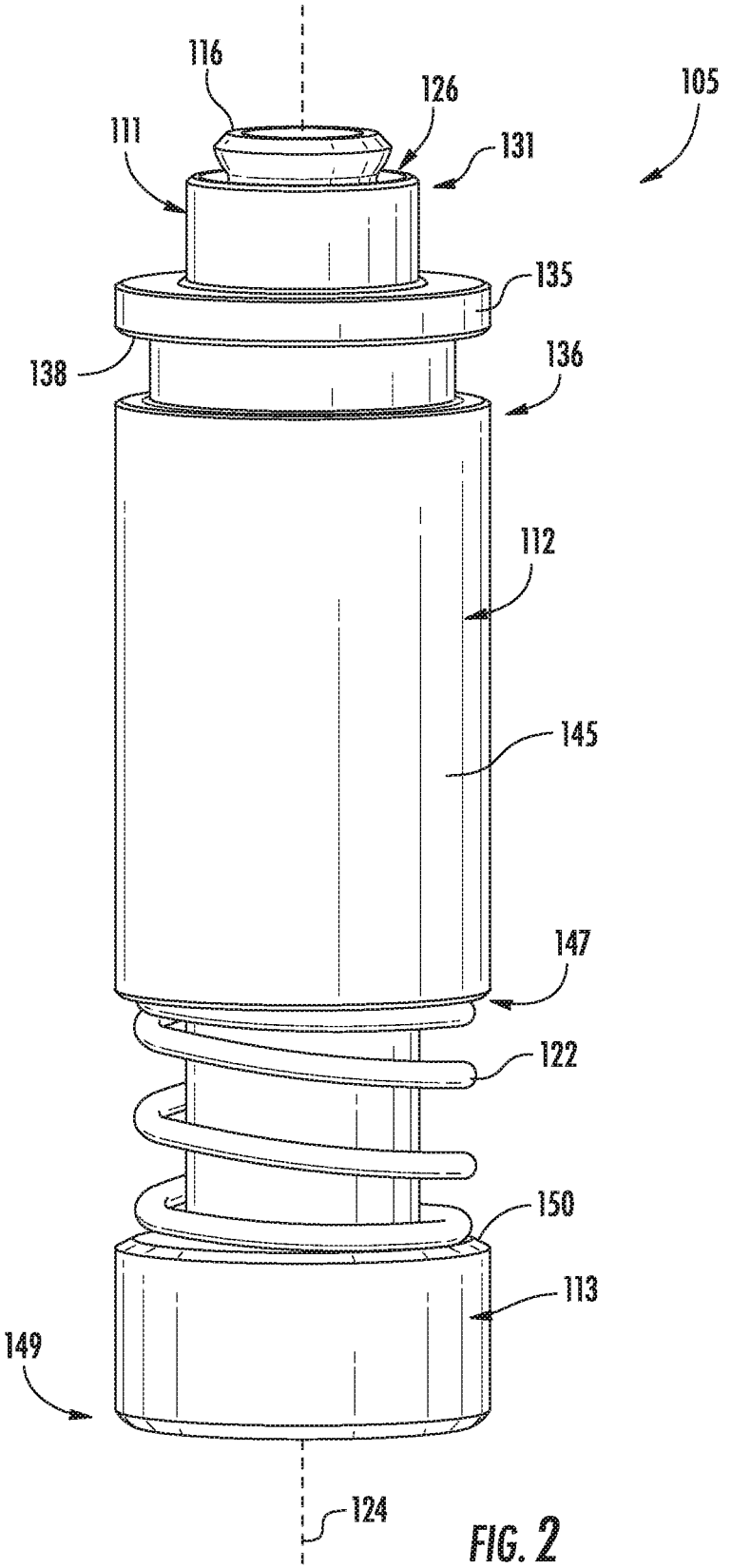
FIG. 2 depicts a perspective view of a bi-stable actuator of the latching assembly of FIG. 1 according to embodiments of the present disclosure.
Figure 3:
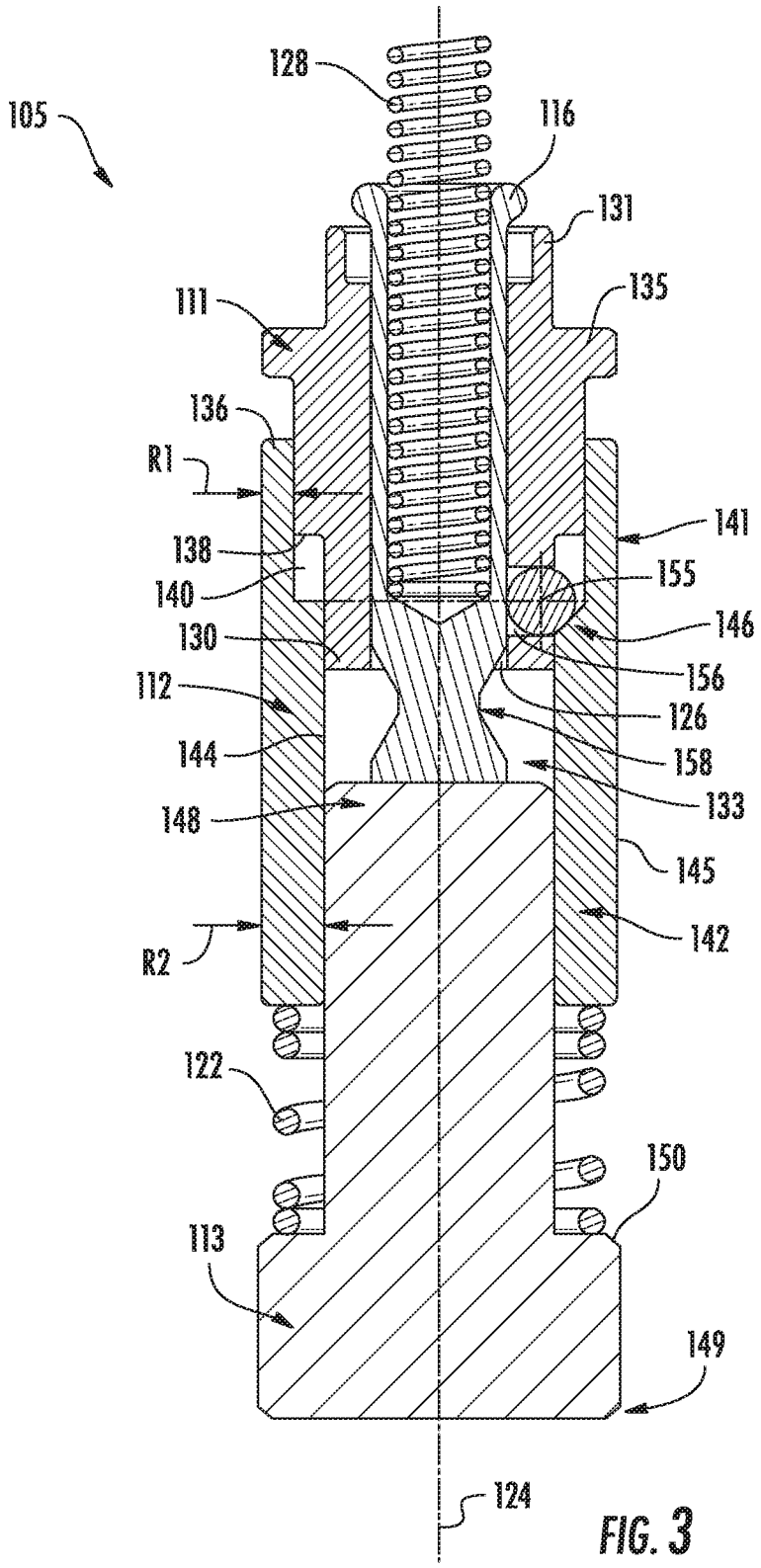
FIG. 3 is a side cross-sectional view of the bi-stable actuator of FIG. 2 according to embodiments of the present disclosure.

Turning now to FIGS. 2-3, the actuator 105 of the present disclosure will be described in greater detail. As shown, the first, second, and third core components 111, 112, and 113 are coupled together, for example, concentrically about a central longitudinal axis 124. The first core component 111 may include a central bore 126 containing the shaft 116 and a shaft spring 128. The first core component 111 may include a first end 130 opposite a second end 131, wherein the first end 130 extends within an interior cavity 133 of the second core component 112 and the second end 131 generally extends outside the second core component 112. The first core component 111 may further include a flange 135 protruding or extending radially from the central longitudinal axis 124, the flange 135 operable to engage a first end 136 of the second core component 112 depending on the relative positions of the first and second core components 111, 112. As shown, the first core component 111 may also include a stopping surface 138 facing the second and third core components 112, 113. In some embodiments, a cavity 140 may be formed between the stopping surface 138 and the second core component 112 depending on the relative positions of the first and second core components 111, 112.

As further shown, the second core component 112 may be a hollow cylinder including a first region 141 having a first radial thickness (R1) between an interior surface 144 and an exterior surface 145, and a second region 142 having a second radial thickness (R2) between the interior and exterior surfaces 144, 145. The second core component 112 may further include a shoulder region 146 between the first and second regions 141, 142. The shoulder region 146 and the stopping surface 138 may engage or abut one another depending on the relative axial positions of the first and second core components 111, 112. As further shown, a second end 147 of the second core component 112 is engaged with one end of the core spring 122.

The third core component 113 may include a first end 148 opposite a second end 149, wherein the first end 148 extends within the interior cavity 133 of the second core component 112. As shown, the first end 148 may have a smaller diameter than the second end 149. The core spring 122 may surround the third core component 113, extending between the second end 147 of the second core component 112 and a flange 150 of the third core component 113. A spring force of the core spring 122 biases the second and third components 112, 113 away from one another.

The actuator 105 may further include one or more positioning spheres 155 extending through an opening 156 of the first core component 111. In some embodiments, a plurality of positioning spheres 155 may be arranged circumferentially about the first core component 111. As will be described in greater detail herein, the positioning sphere 155 may be partially disposed within the cavity 140, and may abut the second core component 112 when the actuator 105 is in a first position (shown) and abut a detent 158 of the shaft 116 when the actuator 105 is in a second position. As shown, the positioning sphere 155 may be in direct physical contact with the shoulder region 146 of the second component.

Figure 4B:
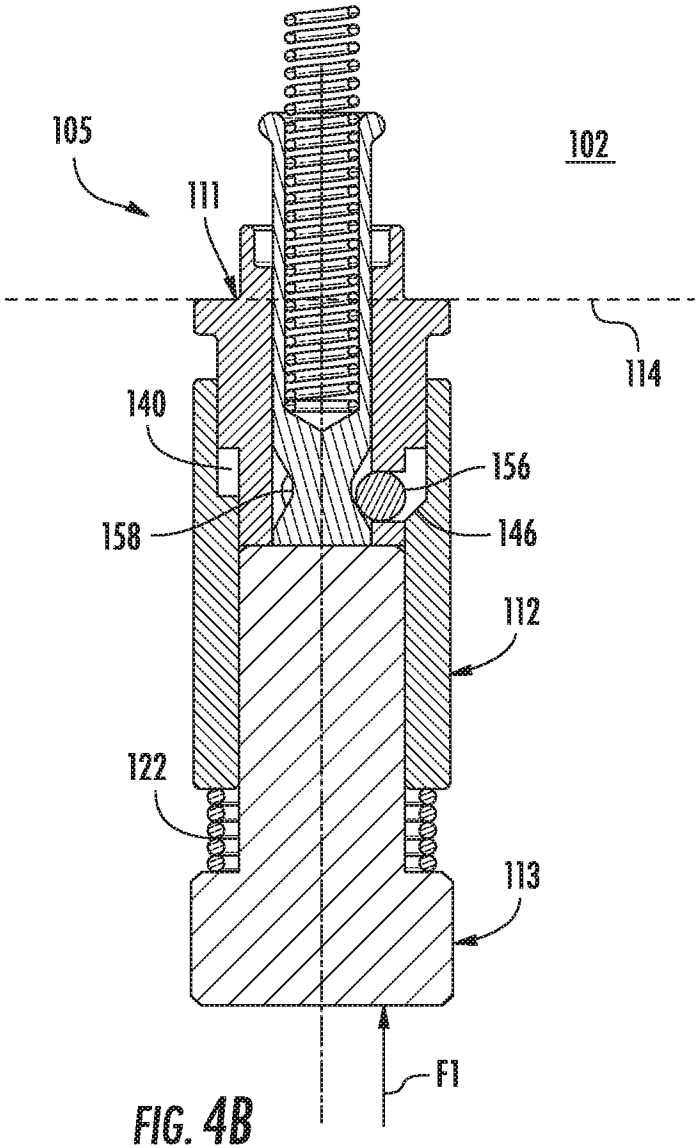
FIGS. 4A-4F depict an approach for operating the bi-stable actuator of FIGS. 2-3 according to embodiments of the disclosure.
Figure 4A:
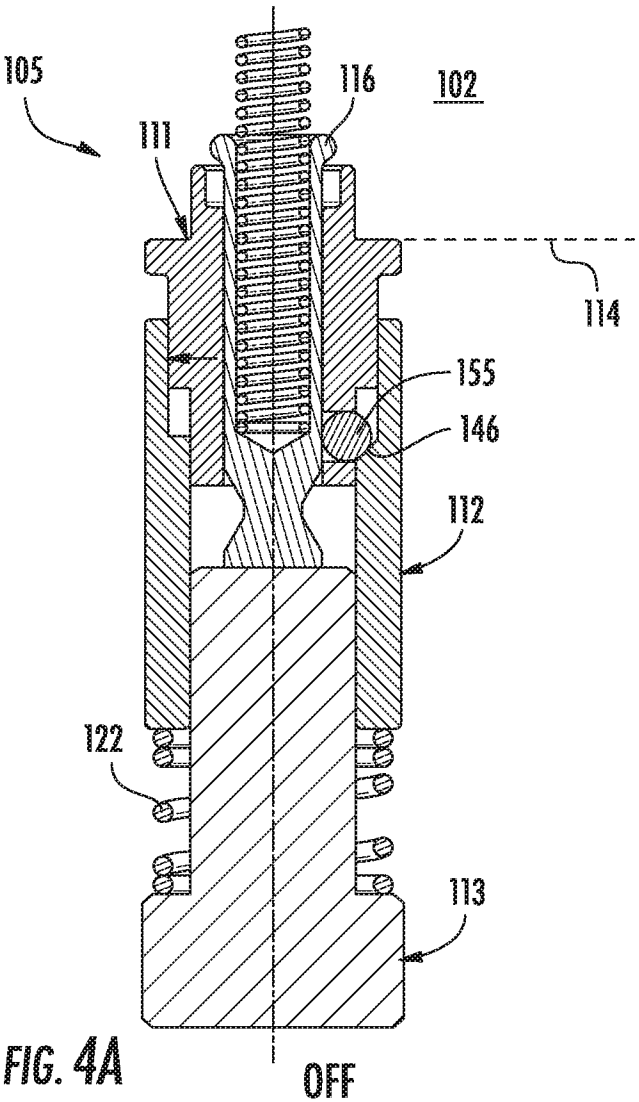

Turning now to FIGS. 4A-4F, operation of the actuator 105 according to embodiments of the present disclosure will be described. As shown in FIG. 4A, the actuator may be in an 'OFF' position in which no forces are acting on the first, second, and/or third components 111, 112 and 113 except for the spring force from the core spring 122. The positioning sphere 155 is in external/blocked position, engaged on one side by the shoulder region 146 of the second core component 112 and engaged on a second side by an exterior surface of the shaft 116. In this embodiment, the first core component 111 may remain fixed in place relative to the underside 114 of the housing 102.

As shown in FIG. 4B, as a force (F1) is received by the third core component 113, the third core component 113 moves axially towards the first core component 111 (upward in the orientation shown), thereby compressing the core spring 122. Movement of the third core component 113 further causes the shaft 116 to move axially, aligning the detent 158 with the opening 156 of the first core component 111. The positioning sphere 155 is free to move radially inward towards the central longitudinal axis 124. As shown, the positioning sphere 155 may be engaged with the detent 158 of the shaft 116 but not the shoulder region 146 of the second core component 112. The positioning sphere 155 may remain in place against the detent 158. As a result, the shaft 116 is prevented from moving axially by the positioning sphere 155.

Figure 4D:
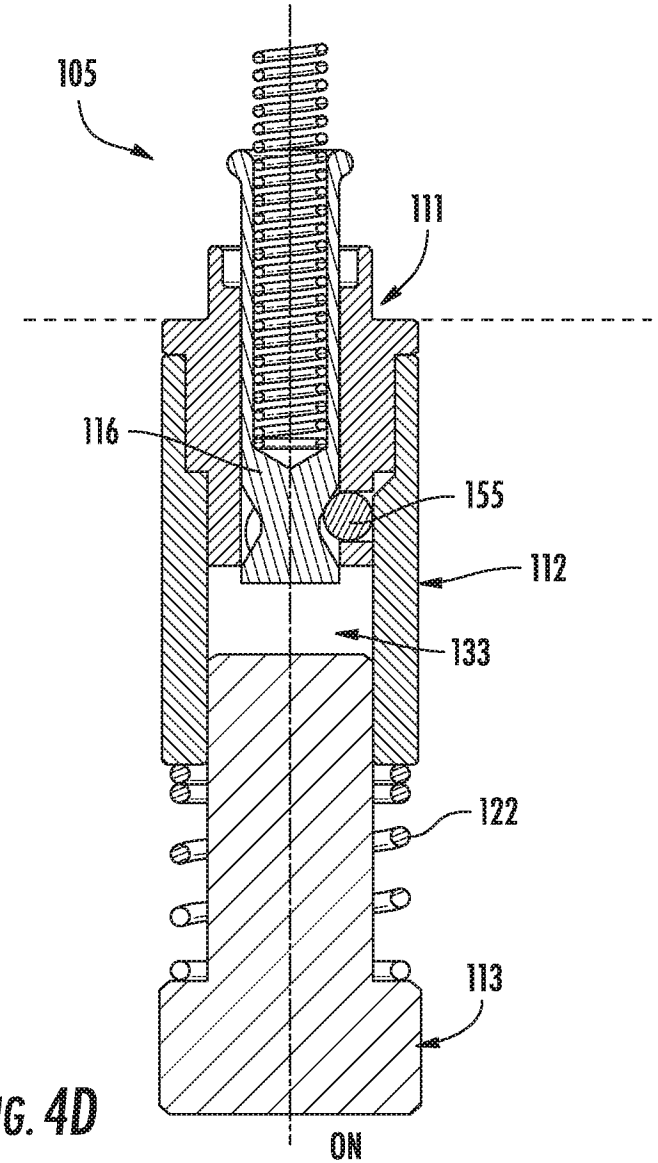
Figure 4C:
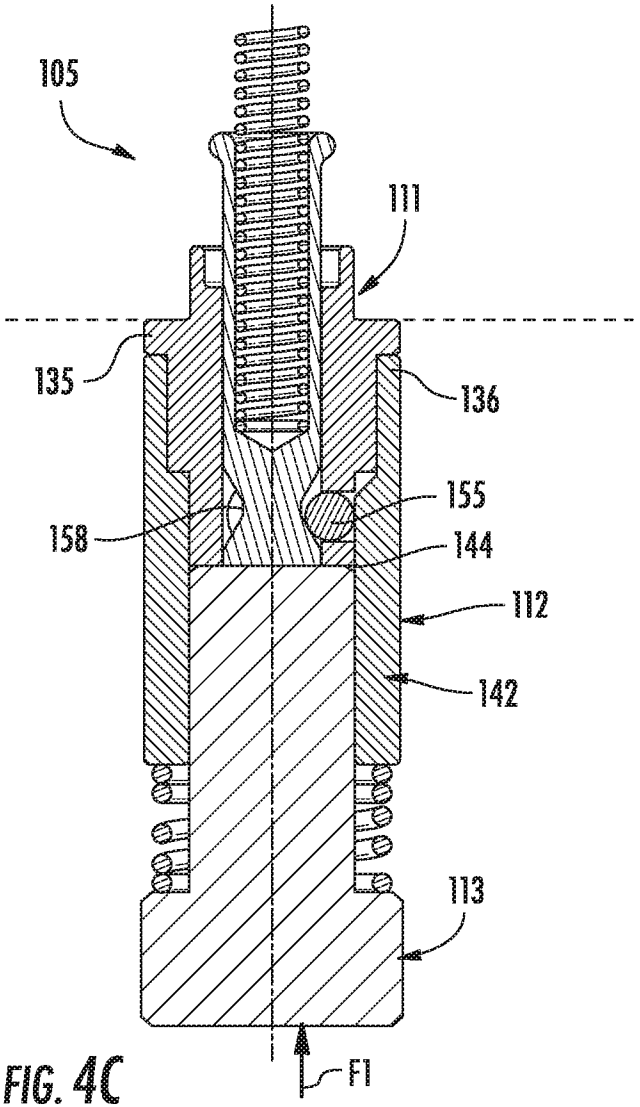
Figure 4F:
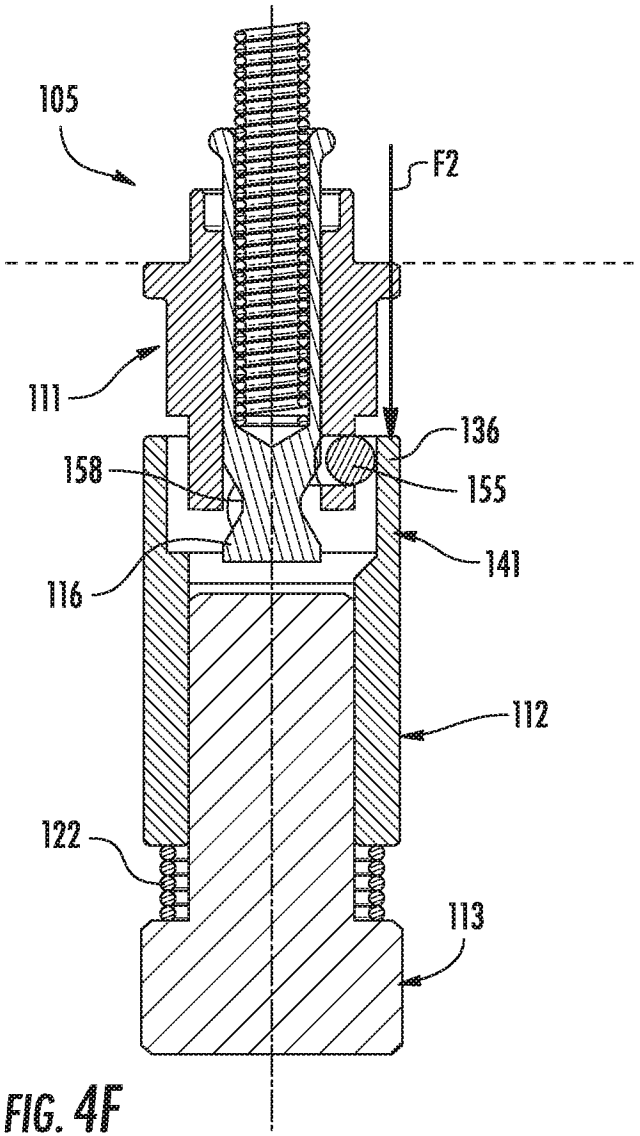

Next, as shown in FIG. 4C, the second and third core components 112, 113 may be biased towards the first core component 111 to bring the first end 136 of the second core component 112 into abutment with the flange 135 of the first core component 111. Movement of the second core component 112 may cause the cavity 140 (FIG. 4B) to be partially or fully eliminated. As the second core component 112 moves axially relative to the first core component 111 and the shaft 116, the positioning sphere 155 may engage the second core component 112, for example, along the interior surface 144 of the second region 142. The shaft 116 and the positioning sphere 155 may be fixed during this step.

Next, as shown in FIG. 4D, once the force is removed from the third core component 113, the third core component 113 may be biased away from the first and second core components 111, 112 by the spring force of the core spring 122. The interior cavity 133 may enlarge, causing a gap to be form between the first end 148 of the third core component 113 and the shaft 116. The shaft 116 and the positioning sphere 155 may remain fixed during this step, which represents an 'ON' position of the actuator 105.

Figure 4E:
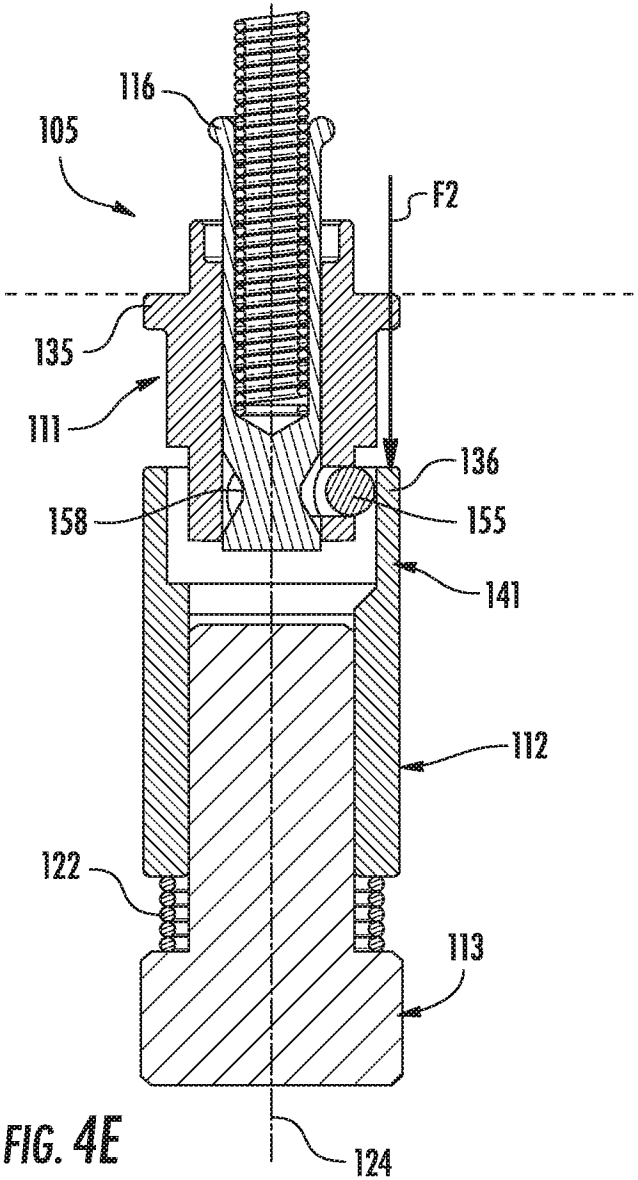

Next, as shown in FIG. 4E, a second force (F2) may be applied to the second core component 112, causing the first end 136 of the second core component 112 to disengage from the flange 135 of the first core component 111. The positioning sphere 155 is no longer engaged with the interior surface 144 of the second region 142 of the second core component 112. Instead, the positioning sphere 155 may now be aligned with or adjacent to the first region 141 of the second core component 112. Due to the smaller first radial thickness of the first region 141, the positioning sphere 155 is free to move radially away from the central longitudinal axis 124. As shown, the positioning sphere 155 is no longer engaged with the detent 158 of the shaft 116, which permits the shaft 116 to move axially downward, as demonstrated in FIG. 4F. To return the OFF position of FIG. 4A, the second force may be removed, permitting the core spring 122 to bias the third core component 113 away from the second core component 112.

For the sake of convenience and clarity, terms such as "top," "bottom," "upper," "lower," "vertical," "horizontal," "lateral," and "longitudinal" are used herein to describe the relative placement and orientation of components and their constituent parts as appearing in the figures. The terminology will include the words specifically mentioned, derivatives thereof, and words of similar import.

As used herein, an element or operation recited in the singular and proceeded with the word "a" or "an" is to be understood as including plural elements or operations, until such exclusion is explicitly recited. Furthermore, references to "one embodiment" of the present disclosure are not intended as limiting. Additional embodiments may also incorporating the recited features.

Furthermore, the terms "substantial" or "substantially," as well as the terms "approximate" or "approximately," can be used interchangeably in some embodiments, and can be described using any relative measures acceptable by one of ordinary skill in the art. For example, these terms can serve as a comparison to a reference parameter, to indicate a deviation capable of providing the intended function. Although non-limiting, the deviation from the reference parameter can be, for example, in an amount of less than 1%, less than 3%, less than 5%, less than 10%, less than 15%, less than 20%, and so on.

Still furthermore, one of skill will understand when an element or component is referred to as being formed on, deposited on, or disposed "on," "over" or "atop" another element, the element can be directly on the other element or intervening elements may also be present. In contrast, when an element is referred to as being "directly on," "directly over" or "directly atop" another element, no intervening elements are present.

The present disclosure is not to be limited in scope by the specific embodiments described herein. Indeed, other various embodiments of and modifications to the present disclosure, in addition to those described herein, will be apparent to those of ordinary skill in the art from the foregoing description and accompanying drawings. Thus, such other embodiments and modifications are intended to fall within the scope of the present disclosure. Furthermore, the present disclosure has been described herein in the context of a particular implementation in a particular environment for a particular purpose. Those of ordinary skill in the art will recognize the usefulness is not limited thereto and the present disclosure may be beneficially implemented in any number of environments for any number of purposes. Thus, the claims set forth below are to be construed in view of the full breadth and spirit of the present disclosure as described herein.

What is claimed is:

1. A latching assembly, comprising:

a housing including an opening; and a bi-stable actuator, comprising:

a first core component in abutment with the housing, the first core component including a central bore including a shaft and a shaft spring, wherein the shaft spring is positioned within an interior of the shaft;

a second core component extending around the first core component, wherein the second core component and the first core component are axially moveable relative to one another;

a third core component extending within the second core component, wherein the third core component and the second core component are axially moveable relative to one another, and wherein the third core component is positioned directly adjacent an interior surface of the second core component; and a positioning sphere extending through an opening of the first core component, wherein the positioning sphere abuts the second core component when the bi-stable actuator is in a first position, and wherein the positioning sphere abuts a detent of the shaft when the bi-stable actuator is in a second position.

2. The latching assembly of claim 1, wherein the positioning sphere is disposed within a cavity between the first core component and the second core component in the first position.

3. The latching assembly of claim 1, the second core component comprising:

a first region having a first radial thickness between an interior surface and an exterior surface;

a second region having a second radial thickness between the interior surface and the exterior surface, wherein the second radial thickness is greater than the first radial thickness; and a shoulder region between the first and second regions, wherein the positioning sphere is in physical contact with the shoulder region when the bi-stable actuator is in the first position.

4. The latching assembly of claim 1, further comprising a core spring in contact with the second core component and the third core component.

5. The latching assembly of claim 4, the second core component comprising a first end and a second end, wherein the first end is operable to engage a flange of the first core component, and wherein the second end is engaged with the core spring.

6. The latching assembly of claim 1, wherein the first core component is concentrically disposed about a central longitudinal axis, and wherein the second core component is concentrically disposed about the first core component.

7. The latching assembly of claim 1, further comprising one or more additional positioning spheres located along a circumference of the first core component.

8. The latching assembly of claim 1, wherein the first core component is in abutment with an underside of the housing, and wherein the shaft extends through an opening of the housing.

9. A bi-stable mechanical latching actuator, comprising:

a first core component in abutment with a housing, the first core component including a central bore receiving a shaft and a shaft spring, wherein the shaft spring is positioned within an interior of the shaft;

a second core component extending around the first core component, wherein the second core component and the first core component are axially moveable relative to one another;

a third core component extending within the second core component, wherein the third core component and the second core component are axially moveable relative to one another, and wherein the third core component is positioned directly adjacent an interior surface of the second core component; and a positioning sphere extending through an opening of the first core component, wherein the positioning sphere abuts the second core component when in a first position, and wherein the positioning sphere abuts a detent of the shaft when in a second position.

10. The bi-stable mechanical latching actuator of claim 9, wherein the positioning sphere is disposed within a cavity between the first core component and the second core component in the first position.

11. The bi-stable mechanical latching actuator of claim 9, the second core component comprising:

a first region having a first radial thickness between an interior surface and an exterior surface;

a second region having a second radial thickness between the interior surface and the exterior surface, wherein the second radial thickness is greater than the first radial thickness; and a shoulder region between the first and second regions, wherein the positioning sphere is in physical contact with the shoulder region when the bi-stable actuator is in the first position.

12. The bi-stable mechanical latching actuator of claim 9, further comprising a core spring in contact with the second core component and the third core component.

13. The bi-stable mechanical latching actuator of claim 12, the second core component comprising a first end and a second end, wherein the first end is operable to engage a flange of the first core component, and wherein the second end is engaged with the core spring.

14. The bi-stable mechanical latching actuator of claim 9, wherein the first core component is concentrically disposed about a central longitudinal axis, and wherein the second core component is a cylinder concentrically disposed about the first core component.

15. The bi-stable mechanical latching actuator of claim 9, further comprising one or more additional positioning spheres located along a circumference of the first core component.

16. A method, comprising:

providing a bi-stable actuator, the bi-stable actuator comprising:

a first core component in abutment with a housing, the first core component including a central bore including a shaft and a shaft spring, wherein the shaft spring is positioned within an interior of the shaft;

a second core component extending around the first core component, wherein the second core component and the first core component are axially moveable relative to one another;

a third core component extending within the second core component, wherein the third core component and the second core component are axially moveable relative to one another; and a positioning sphere positioned within an opening of the first core component;

biasing the third core component within the second core component from a first radial position to a second radial position, wherein the positioning sphere abuts the second core component when the third core component is in the first radial position, and wherein the positioning sphere abuts a detent of the shaft when the third core component is in the second radial position; and biasing, in response to an external force acting on the third core component, the second core component and the third core component towards the first core component, wherein a first end of the second core component abuts a flange of the first core component, and wherein the positioning sphere is in abutment with the second core component and the detent of the shaft.

17. The method according to claim 16, further comprising biasing, in response to a spring force from a core spring positioned between the third core component and the second core component, the third core component away from the first core component, wherein the first end of the second core component remains in abutment with the flange of the first core component, and wherein the positioning sphere remains in abutment with the second core component and the detent of the shaft.

18. The method according to claim 17, further comprising biasing, in response to a second external force acting on the second core component, the second core component away from the first core component, wherein the first end of the second core component is no longer in abutment with the flange of the first core component, and wherein the positioning sphere is no longer in abutment with the detent of the shaft.

19. The method according to claim 17, further comprising biasing, in response to a spring force from the shaft spring, the shaft towards the third core component.

* * * * *